United States Patent [19]

Bettge et al.

[11] Patent Number: 4,540,863

[45] Date of Patent: Sep. 10, 1985

[54] VACUUM-SWITCHING TUBE, ESPECIALLY FOR A LOW-VOLTAGE CONTACTOR

[75] Inventors: Hans Bettge; Günther Bialkowski; Ernst-Ludwig Hoene, all of Berlin, Fed. Rep. of Germany

[73] Assignee: Siemens Aktiengesellschaft, Berlin and Munich, Fed. Rep. of Germany

[21] Appl. No.: 634,983

[22] Filed: Jul. 27, 1984

[30] Foreign Application Priority Data

Jul. 29, 1983 [DE] Fed. Rep. of Germany ..... 3327390

[51] Int. Cl.[3] ..... H01N 33/66

[52] U.S. Cl. ..... 200/144 B

[58] Field of Search ..... 200/144 B

[56] References Cited

U.S. PATENT DOCUMENTS

| | | | |
|---|---|---|---|
| 3,082,307 | 3/1963 | Greenwood et al. | 200/144 B |
| 3,590,185 | 6/1971 | Pflanz | 200/144 B |
| 3,812,314 | 5/1974 | Nonken | 200/144 B |

*Primary Examiner*—Robert S. Macon

*Attorney, Agent, or Firm*—Herbert L. Lerner; Laurence A. Greenberg

[57] ABSTRACT

A vacuum-switching tube for a vacuum switch having two poles and producing metal vapor during switching, includes a housing having a metal vessel partially defining a switching chamber and at least one high temperature-resistant insulator disposed axially of the metal vessel outside the switching chamber, the insulator having a side facing away from the switching chamber and the insulator having a relatively small axial height being at least sufficient for insulating the two poles of the vacuum switch at given voltages expected in the vacuum-switching tube during operation, fixed and movable coaxial switching contacts disposed in the switching chamber, a shaft connected to the movable contact for moving the movable contact in axial direction, a device for shielding the insulator from the metal vapor produced during switching, the shielding device defining a boundary of the switching chamber in axial direction, accordion bellows disposed outside the switching chamber and adjacent the side of the insulator facing away from the switching chamber for vacuum-tightly sealing the movable contact, and an insulating cap resting against the insulator and surrounding the insulator and the accordion bellows, the insulating cap including a guide bearing for guiding the shaft.

12 Claims, 4 Drawing Figures

VACUUM-SWITCHING TUBE, ESPECIALLY FOR A LOW-VOLTAGE CONTACTOR

The invention relates to a vacuum-switching tube, particularly for low-voltage contactors, including a switching chamber, a fixed and a movable switching contact with a connecting post in the switching chamber, the switching contacts being mutually coaxially disposed and being movable relative to each other in the axial direction, a housing having at least one high temperature-resistant insulator and metal parts, a device for shielding the insulator from metal vapor produced during the switching, a guide bearing for the movable contact, and accordion bellows for vacuum-tightly sealing the movable contact, the accordion bellows being disposed outside the switching chamber. Such a vacuum-switching tube is known from German Published, Prosecuted, Application DE-AS No. 1 261 219.

Operating currents of up to 630 A must be switched very frequently at voltages of about 500 V to 1000 V, especially in the case of low-voltage contactors. Switching cycles of 10 million are desired. Therefore, the accordion bellows which are required for connecting the movable contact to the housing in a vacuum-tight manner must meet stringent requirements as to fatigue strength. For a given switching stroke, these bellows must be kept relatively large in order to prevent overstressing the material of which the bellows are made. On the other hand, a relatively large accumulation of evaporated switching contact material must be expected with such high numbers of switching cycles; this material must be kept away from the insulator disposed between the contacts.

It is furthermore necessary to guide the movable contact axially in the vacuum-switching tube, because lateral excursions of the bellows reduce the durability and because the contacts must be axially aligned for solving the switching problem in question. To this end, a guide bearing for the movable contact is necessary, among other things.

It is accordingly an object of the present invention to provide a vacuum-switching tube, especially for a low-voltage contactor, which overcomes the hereinaforementioned disadvantages of the heretofore-known devices of this general type, which is as small as possible and which is inexpensive.

With the foregoing and other objects in view there is provided, in accordance with the invention, a vacuum-switching tube, especially for low-voltage contactors, for a vacuum switch having two poles and producing metal vapor during switching, comprising a housing including a metal vessel partially defining a switching chamber and at least one high temperature-resistant insulator disposed axially of the metal vessel outside the switching chamber, the insulator having a side facing away from the switching chamber and the insulator having a relatively small axial height being at least sufficient for insulating the two poles of the vacuum switch at given voltages expected in the vacuum-switching tube during operation, a fixed and a movable coaxial switching contact disposed in the switching chamber, a shaft connected to the movable contact for moving the movable contact in axial direction, a device for shielding the insulator from the metal vapor produced during switching, the shielding device defining a boundary of the switching chamber in axial direction, accordion bellows disposed outside the switching chamber and adjacent the side of the insulator facing away from the switching chamber for vacuum-tightly sealing the movable contact, and an insulating cap resting closely against the insulator and surrounding the insulator and the accordion bellows, the insulating cap including a guide bearing for guiding the shaft.

This embodiment permits the construction of a small insulator constructed only for the operating voltages, since the leakage path for the voltage between the switching contacts is quite considerably larger than the dimension of the insulator in the axial direction because of the strucure of the insulating material cap. This is due to the fact that the leakage path(along which discharges can occur in practice in the off position due to the humidity of the air and contamination), is considerably longer than the insulating path required in a vacuum. This long leakage path is ensured on one hand, by the close fit of the insulating material cap to the insulator and on the other hand, by the formation of the bearing bushing for the movable contact at the insulating material cap. At the same time, the accordion bellows are protected against external damage by the insulating material cap. The bellows need only have the wall thickness required for sealing which is less than 0.2 mm.

In the proposed vacuum-switching tube, the insulator may be formed of glass or a ceramic material, and the insulator need not have a particular surface since the leakage path is ensured by the insulating material cap. Considerable costs are saved in this way.

In accordance with another feature of the invention, the switching chamber, insulator and insulating material cap are rotationally symmetrical, the insulator is a circular ring having another side facing toward the switching chamber, the shielding device includes two shielding rings each being soldered to a respective side of the insulator, one of the shielding rings being brazed or welded to the metal vessel and the other of the shielding rings being brazed or welded to the accordion bellows, each of the shielding rings have an annular region extended into the interior of the insulator, and the annular regions defining insulating paths therebetween or on or next to the annular regions, being sufficiently long for all voltages occuring during operation. The solder joints are preferably brazed.

In accordance with a further feature of the invention, there is provided a contact post for the fixed contact, the metal vessel having a curved ring region adjacent to and vacuum-tightly connected to the contact post. This provides a simple manner of intercepting temperature variations and vibrations.

A welded joint or a brazed joint are especially well suited for a vacuum-tight connection, since the necessary temperature stability and mechanical strength are ensured thereby.

In accordance with an added feature of the invention, the insulating material cap encloses the switching chamber, includes a mounting flange, and has an opening formed therein, and including casting material filling the opening in vicinity of the switching chamber. This provides a particularly well mechanically protected and easy to assemble embodiment.

In accordance with an additional feature of the invention, the mounting flange extends in axial direction.

In accordance with again another feature of the invention, the mounting flange is perpendicular to the rotational axis of the switching tube and is disposed on a side of the insulating material cap at which the fixed contact is disposed. The fastening flange advantageously runs parallel to the axis if the vacuum-switching tube is to be installed horizontally, or perpendicular to the axis of rotation on the side of the fixed contact if the vacuum-switching tube is to be installed upright.

In accordance with again an added feature of the invention, the insulating material cap is formed of fiberglass-reinforced plastic.

In accordance with again an additional feature of the invention, the insulating material cap is closely fitted and connected to the insulator, i.e. it has an intimate connection. Cementing with an adhesive is suitable for this. However, the joint can also be made by casting.

In accordance with yet another feature of the invention, there are included means disposed at the shielding device for snapping the insulator into and connecting the insulator to the insulating material cap. The shielding ring facing the switching chamber is preferably used, or constructed as part of, the snap-in connection.

All these types of connections permit an extension of the leakage path in the desired form.

In accordance with a concomitant feature of the invention, there are provided cooling fins integral with the insulating material cap.

With the above-described construction of the mounting flanges, the switching tube can be installed without additional insulation. This means, among other things, that the electrical connections of the switching tubes in the switch gear can be of low-cost construction, since a separation of the mechanical function (mounting) from the electrical function (current conduction and voltage insulation) is possible.

Other features which are considered as characteristic for the invention are set forth in the appended claims.

Although the invention is illustrated and described herein as embodied in a vacuum-switchihg tube, especially for a low-voltage contactor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
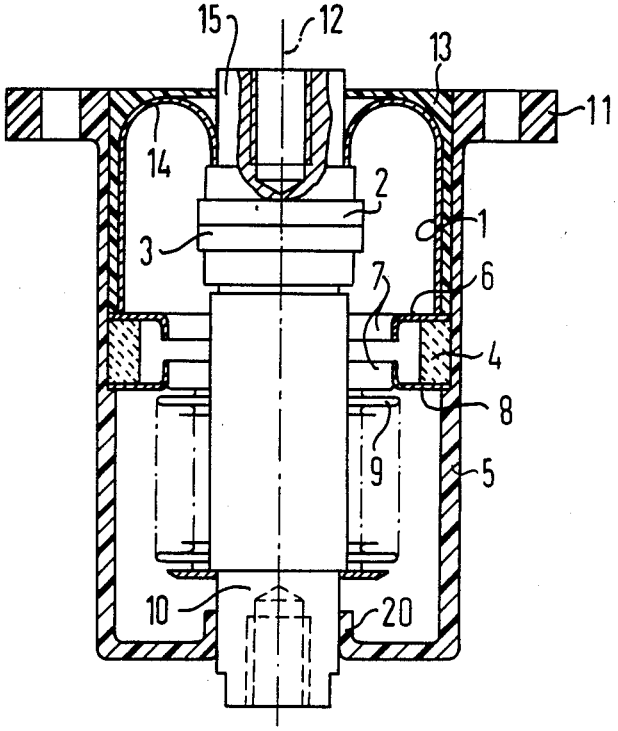
FIG. 1 is a diagrammatic, cross-sectional view of an embodiment of the vacuum switching tube according to the invention, with a mounting flange disposed perpendicular to the axis of rotation.

Referring now to the figures of the drawing in detail and first particularly to FIG. 1 thereof, there is seen a switching chamber 1, in which a fixed contact 2 and a movable contact 3 are accomodated. A shielding ring 6 is connected to the switching chamber 1 in a vacuum-tight manner, preferably by brazing or welding. The shielding ring 6 has an annular region 7, which extends into the interior of a circular ring in the form of an insulator 4. The shielding ring 6 is vacuum-tightly connected to the end surface of the insulator 4, preferably by brazing or welding.

A shielding ring 8 is vacuum-tightly connected to the opposite end surface of the insulator 4. The shielding ring 8 also has a ring region 7 protruding into the interior of a circular ring formed by the insulator 4. Accordion bellows 9 are also connected to the shielding ring 8. The accordion bellows 9 are in turn vacuum-tightly connected to a shaft 10 of the movable contact 3.

An insulating material cap 5 encloses the insulator 4 with a close fit and forms a guide bearing 20 for guiding the stem or shaft 10 of the movable switching contact 3.

The insulating material cap 5 extends beyond the insulator 4 and forms a mounting flange 11 which is perpendicular to the rotational axis 12 of the vacuum-switching tube.

The opening of the insulating material cap 5 is filled with casting material 13 and thereby insulates the switching chamber 1. The switching chamber 1 has a curved annular region 14 in vicinity of the fixed contact 2 which preferably rests tangentially against a contact post 15 of the fixed contact and which is connected thereto in a vacuum-tight manner. The curved annular region 14 permits length changes due to temperature variations to be compensated. Vibrations can also be intercepted thereby. Vibrations are generated, in particular, by lateral excursions of the movable contact 3 during the switching operation which are caused, for instance, by current forces which occur during the closing of the contact The placement of the insulator 4 outside the switching chamber 1 is of considerable importance for reducing the outside diameter of the vacuum-switching tube. This can be seen by the fact that in the state of the art, the insulator is included into the wall of the switching chamber, and this requires complete coverage of the insulator by a sheet metal shield. The shield must be disposed at required insulation distances from the metal parts of the opposite pole in the radial direction as well, and must be disposed at a minimum spacing from the contact for a large switching capacity, as is the wall of the switching chamber in the construction according to the invention. The simple construction of the shielding ring shown in FIG. 1 only becomes possible through the structure according to the invention, since only in this manner can the necessary insulation spacings be maintained without the danger of metal vapor getting to the insulator to a disturbing degree through the insulating spacings between the sheet metal shields. The conventional constructions of such switching tubes necessitate considerably larger dimensions of the tubes because of the insulation paths which are also necessary therein but are positioned less favorably.

Among other things, the casting material 13 establishes the tight material connection between the insulating material cap 5 and the insulator 4. The insulating material cap 5 is advantageously formed of fiberglass-reinforced plastic. Fiberglass-reinforced thermoplastic or thermosetting materials such as "Durethane BKV 30" of the firm Hoechst, can also be used.

Figure 2:
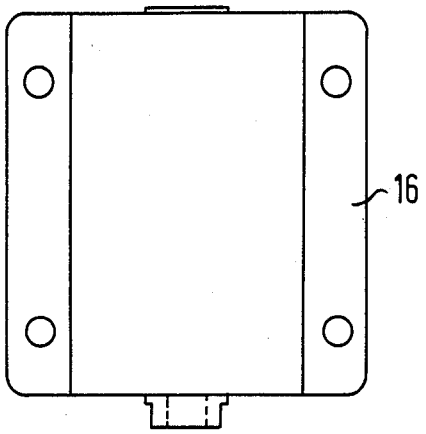
FIGS. 2 and 3 are respective top plan and front-elevational views of another embodiment with mounting flanges disposed parallel to the axis.
Figure 3:
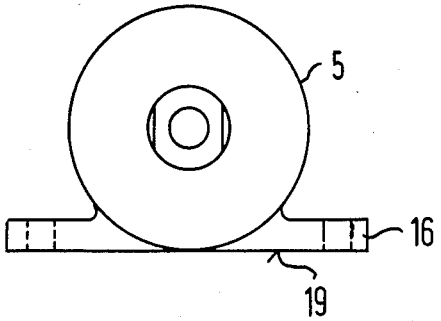

FIGS. 2 and 3 show embodiments in which a flange 16 is disposed parallel to the axis. According to FIG. 3, one surface 19 of the flange 16 tangentially touches the periphery of the insulating material cap 5.

Figure 4:
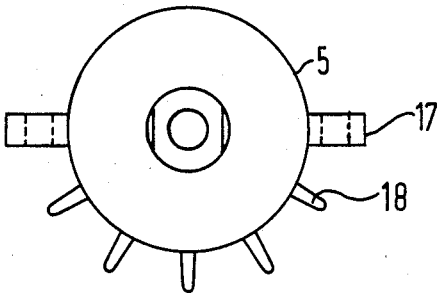
FIG. 4 is a front-elevational view of a further embodiment in which the mounting flange is also parallel to the axis.

In a further embodiment according to FIG. 4, a flange 17 is provided parallel to the axis. The plane of symmetry of the flange 17 contains the rotational axis of the vacuum-switching tube.

FIG. 4 also shows cooling fins 18 which, if required, can be formed on the insulating material cap 5.

The foregoing is a description corresponding in substance to German Application P No. 33 27 390.1, filed July 29, 1983, the International priority of which is being claimed for the instant application, and which is hereby made part of this application. Any material discrepancies between the foregoing specification and the aforementioned corresponding German application are to be resolved in favor of the latter.

We claim:

1. Vacuum-switching tube for a vacuum switch having two poles and producing metal vapor during switching, comprising a housing including a metal vessel partially defining a switching chamber and at least one high temperature-resistant insulator disposed axially of said metal vessel outside said switching chamber, said insulator having a side facing away from said switching chamber and said insulator having a relatively small axial height being at least sufficient for insulating the two poles of the vacuum switch at given voltages expected in the vacuum-switching tube during operation, a fixed and a movable coaxial switching contact disposed in said switching chamber, a shaft connected to said movable contact for moving said movable contact in axial direction, a device for shielding said insulator from the metal vapor produced during switching, said shielding device defining a boundary of said switching chamber in axial direction, accordion bellows disposed outside said switching chamber and adjacent said side of said insulator facing away from said switching chamber for vacuum-tightly sealing said movable contact, and an insulating cap resting against said insulator and surrounding said insulator and said accordion bellows, said insulating cap including a guide bearing for guiding said shaft.

2. Vacuum-switching tube according to claim 1, wherein said switching chamber, insulator and insulating material cap are rotationally symmetrical, said insulator is a circular ring having another side facing toward said switching chamber, said shielding device includes two shielding rings each being soldered to a respective side of said insulator, one of said shielding rings being joined to said metal vessel and the other of said shielding rings being joined to said accordion bellows, each of said shielding rings have an annular region extended into the interior of said insulator, and said annular regions defining insulating paths therebetween sufficiently long for all voltages occuring during operation.

3. Vacuum-switching tube according to claim 2, wherein said shielding rings are joined to said metal vessel and said accordion bellows by brazing.

4. Vacuum-switching tube according to claim 2, wherein said shielding rings are joined to said metal vessel and said accordion bellows by welding.

5. Vacuum-switching tube according to claim 1, including a contact post for said fixed contact, said metal vessel having a curved ring region adjacent to and vacuum-tightly connected to said contact post.

6. Vacuum-switching tube according to claim 1, wherein said insulating material cap encloses said switching chamber, includes a mounting flange, and has an opening formed therein, and including casting material filling said opening in vicinity of said switching chamber.

7. Vacuum-switching tube according to claim 4, wherein said mounting flange extends in axial direction.

8. Vacuum-switching tube according to claim 4, wherein said mounting flange is perpendicular to the rotational axis of the switching tube and is disposed on a side of said insulating material cap at which said fixed contact is disposed.

9. Vacuum-switching tube according to claim 1, wherein said insulating material cap is formed of fiberglass-reinforced plastic.

10. Vacuum-switching tube according to claim 1, wherein said insulating material cap is closely fitted and connected to said insulator.

11. Vacuum-switching tube according to claim 1, including means disposed at said shielding device for snapping said insulator into and connecting said insulator to said insulating material cap.

12. Vacuum-switching tube according to claim 1, including cooling fins integral with said insulating material cap.

* * * * *